United States Patent [19]

Siegmann

[11] 4,194,664

[45] Mar. 25, 1980

[54] FIRING SAFETY FOR A PNEUMATIC NAILER

[75] Inventor: Carl Siegmann, Bremen, Fed. Rep. of Germany

[73] Assignee: Senco Products, Inc., Cincinnati, Ohio

[21] Appl. No.: 15,419

[22] Filed: Feb. 26, 1979

[30] Foreign Application Priority Data

Mar. 16, 1978 [DE] Fed. Rep. of Germany ..... 2811339

[51] Int. Cl.[2] ..... B25C 1/04

[52] U.S. Cl. ..... 227/8; 91/461; 173/169

[58] Field of Search ..... 91/461; 173/161, 169; 227/8, 130

[56] References Cited

U.S. PATENT DOCUMENTS

| | | | |
|---|---|---|---|
| 2,915,754 | 12/1959 | Wandel | 91/461 X |
| 3,552,270 | 1/1971 | Lange | 91/461 X |

*Primary Examiner*—Paul A. Bell

*Attorney, Agent, or Firm*—Frost & Jacobs

[57] ABSTRACT

A firing safety for a pneumatic nailer or stapler is disclosed. The tool has an inlet or firing valve for pressurized air, and a trigger valve which, upon actuation, connects said inlet valve with the pressurized air through a passageway. The passageway has a opening or port leading to atmosphere, and a manually operable flap valve is provided to close said opening. Thus, when said flap valve is open actuation of the trigger valve and/or a nose-piece sensor safety will not cause the nailer to fire, unless the manually operable flap valve is also operated to close said opening.

5 Claims, 2 Drawing Figures

FIRING SAFETY FOR A PNEUMATIC NAILER

Figure 1:
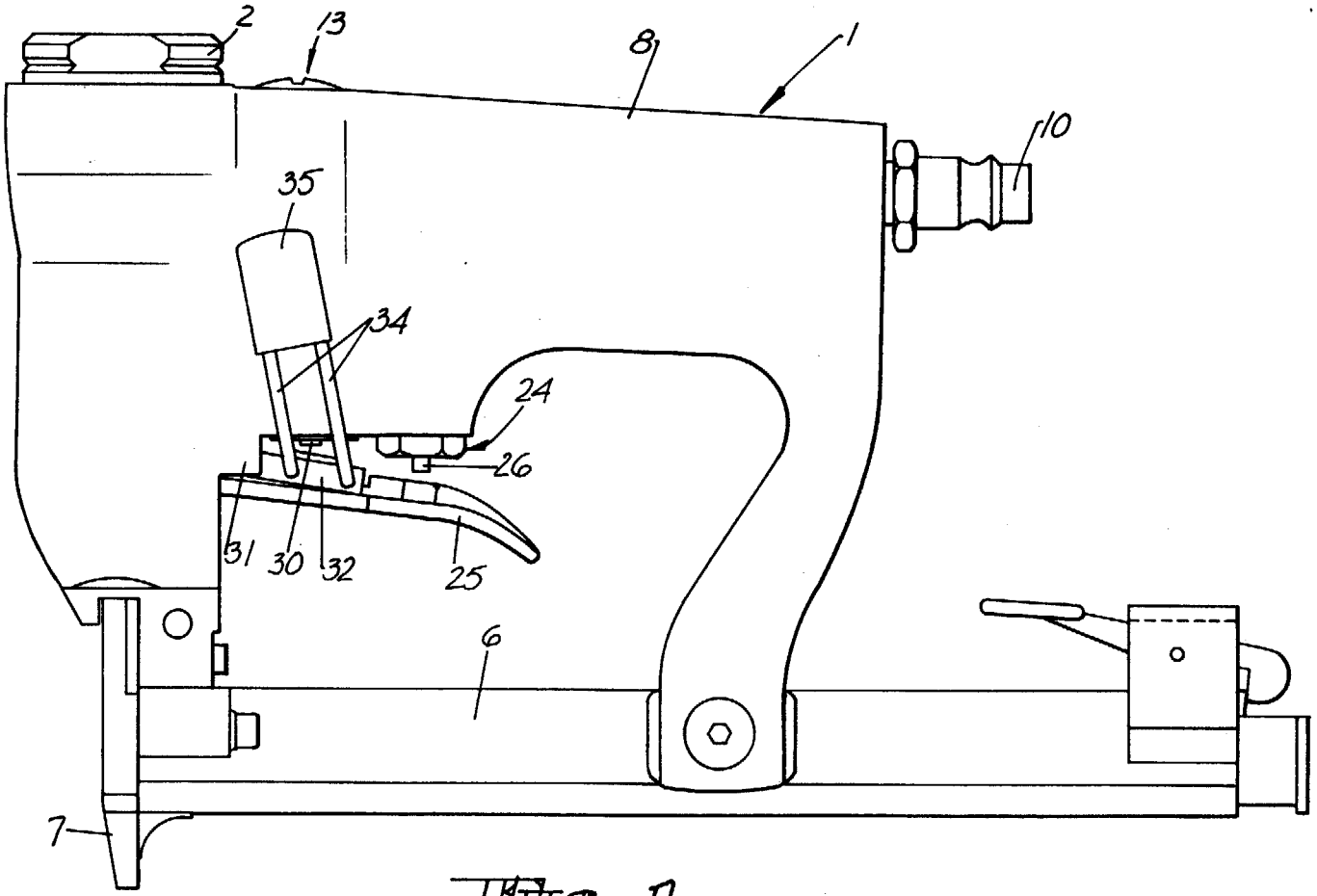

The invention relates to a firing safety for a pneumatic nailer having a pneumatically controlled inlet valve for pressurized air, said inlet valve being subjected to the control by a trigger valve, which causes the valve piston thereof to be impinged by pressurized air via a passageway, for opening the inlet valve.

A pneumatic nailer of this type has been known, for instance, from German patent specification No. 11 47 540 for a long time. Further, several safeties against unintended initiation of a working stroke have become known, since it cannot be excluded that a nail (in the present connection this term includes other drivable fasteners, such as, in particular, staples) may cause damage when undesiredly driven into the open air.

It is common to said known firing safeties that they are subjected to the control of a sensor at the nose-piece of the nailer. A sensing pin projects beyond the underface of the nose-piece and is pressed back when the nose-piece is placed onto an article, usually a workpiece. As long as a sensing pin of the sensor is not depressed, no working cycle can be initiated by means of the manually actuated trigger valve.

For example, it is known from German specification No. 1 503 069 to have the workpiece sensor act on a transmitting lever located between the trigger valve and the manually operable trigger lever, such that in the non-actuated position of the sensor an actuation of the trigger lever is not transmitted to the trigger valve. In contrast to said purely mechanical firing safety, the firing safety known from German laid-open specification No. 21 31 849 engages in the pressurized air control of the inlet valve, in that the workpiece sensor, by moving a cylinder sleeve relative to the valve piston of the trigger valve, renders the valve seat ineffective even in case the trigger lever is actuated, as long as the sensor is not depressed. According to German published application No. 22 24 016 there is associated with the trigger valve an identical valve actuated by the workpiece sensor, and a ball valve located between the two valves allows opening of the inlet valve only when both valves are actuated in concurrence. The same applies to the arrangement known from German laid open application No. 24 53 595, where the workpiece sensor acts on a spring-biased valve located adjacent the nailer nose-piece. This valve prevents exhausting, and hence actuation of an intermediary valve that controls the inlet valve, as long as a workpiece sensor sensing pin in the form of a valve piston has not been depressed, even though the trigger valve is actuated, thereby opening the sensor valve.

Such tip firing safeties are not suitable for small pneumatic nailers. The manufacturing expense required would increase the price for a tool of this type such that many applications for pneumatic nailers would be lost. Moreover, small pneumatic nailers are employed at places where access to the working point is a problem. A tip sensor surrounding the nose-piece of the pneumatic nailer would further enhance that problem, since in such cases the shape of the nose-piece usually has to be specifically adapted to the spacial conditions at the working point.

While on the other hand such small and relatively weak pneumatic nailers are hardly capable of causing large damage upon unintended operation, there exists in fact a need for a firing safety even for such devices.

Thus, it is the object of the invention to provide a simple and inexpensive firing safety for a pneumatic nailer of the above-mentioned kind having an inlet valve that is opened by admission of pressurized air.

According to the invention, this object is solved by a manually operably safety valve located in the passageway (between the trigger valve and the inlet valve for pressurized air), which safety valve closes an opening leading from said passageway to atmosphere, only in its actuated position. As long as the safety valve is not actuated, pressurized air supplied by the actuated trigger valve to the inlet valve, is exhausted to atmosphere and becomes active only, if by additional actuation of the safety valve, the exhausting orifice is closed. Two separate actuating actions are thus required for initiating a working cycle of the pneumatic nailer.

The second manual actuation provided for according to the invention in particular prevents an unintended actuation of the trigger lever from causing the initiation of a working cycle upon gripping the tool, in particular with tools having a trigger lever manipulatively well located below the handle. Such location of the trigger lever is common to modern pneumatic nailers, where the trigger valve is operated by the trigger lever either directly or indirectly by means of a trigger contact.

Preferably, the safety valve consists of a flap pivotally linked at the nailer housing, which flap can be pressed into sealing engagement with said opening in the nailer housing. The structure of such safety valve, in which the flap may be equipped with a rubber seal, is particularly simple. It is advantageous to have the pivot axis of the flap extend transversely of the main plane of the nailer, as in such case there is no danger that the usual sidewise dropping of the tool, when laid aside, would lead to actuation of the safety valve, so that an unintended pull of the trigger lever when taking the tool up would result in an unintended initiation of a working cycle as a consequence of the trigger lever being "armed" by said actuation.

For moving the flap it may be provided with a bow, and the arrangement is preferably made such that the bow is angled upwardly into an oblique position such that it lies within the reach of the thumb of the hand gripping the handle of the pneumatic nailer. For actuation of the safety valve the thumb is required to pivot the flap by a pulling action directed vertically upwards (pivoting the thumb about its root) in order to move the bow. Such manual actuation does not present manipulative problems, but is hardly made unintentionally, so that with a pneumatic nailer equipped in this manner, an unintended initiation of a working cycle can practically be excluded.

An embodiment of the invention is shown in the drawing, where

Figure 2:
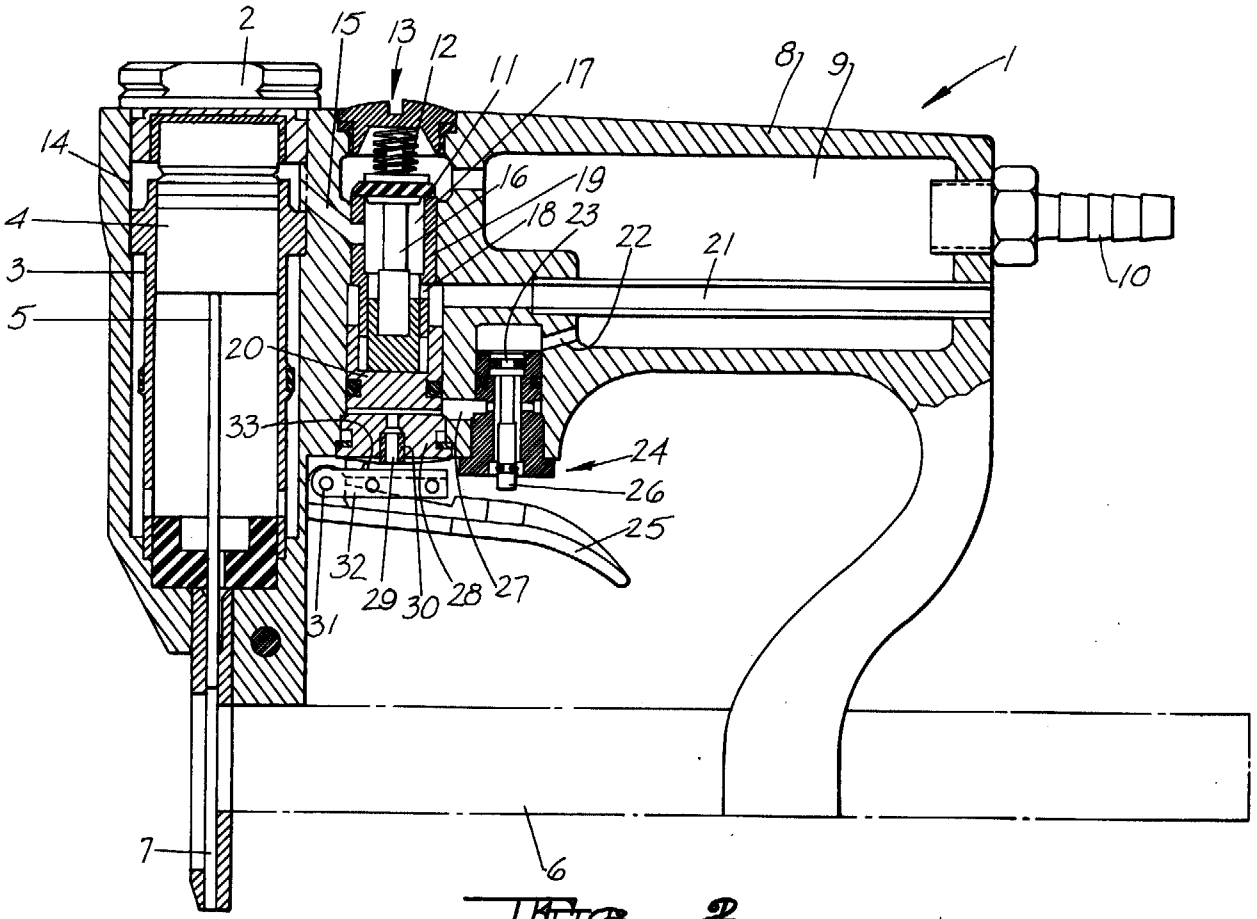

FIG. 1 represents a side view of a pneumatic nailer equipped with the novel safety valve, with the safety valve not being actuated; and FIG. 2 represents a cross-section of the same pneumatic nailer with the safety valve being actuated.

As usual, in the front portion of the nailer housing 1 a working cylinder 3 is located, enclosed by a cover 2. In the working cylinder a working piston 4 carrying a driver 5 is movable. During a working cycle of the working piston 4 the driver drives a fastener element supplied from a magazine 6, out of the nose-piece 7 into a workpiece. The rearward portion of the nailer housing 1 is formed as a handle 8. An air reservoir 9 in the handle 8 is, in operation, supplied with pressurized air through a tube connection 10 and impinges on a valve plate 11 of the inlet valve 13 which is biased into its closed rest position by a spring 12.

In the rest position of the inlet valve 13 space 14 above the working piston 4 is connected to atmosphere via channel 15, space 17 surrounding pin 16 of the inlet valve 13, a bore 18 within cylinder 19 of the actuating piston 20 of inlet valve 13, and a channel 21.

Pressurized air in the reservoir 9 also passes via bore 22, and impinges on piston 23 of a trigger valve 24. By means of a trigger lever 25, pin 26 which is connected with the piston 23 of the trigger valve, can be moved against the action of pressurized air impringing on piston 23, so that pressurized air enters a passageway 27 past piston 23 and pin 26. From there the pressurized air flows below piston 20 of the inlet valve which is opened against the action of spring 12. At the same time venting orifice 18 is closed.

According to the invention, an opening 29 is provided in a cover 28 which closes inlet valve 13 at its bottom end. Opening 29 takes the form of a bore largely lined by a sleeve 30. A flap 32 pivotable about a pivot axis 31 extending transversely of the main plane of nailer housing 1 can be moved from its opened position shown in FIG. 1 into its actuated position shown in FIG. 2, by manual actuation. In the actuated position of flap 32 a liner 33 of rubber or similar elastic material is urged against the orifice of sleeve 30, whereby opening 29 is closed.

As particularly apparent from FIG. 1, a bow 34 is fastened to flap 32, which bow extends—out of the drawing plane of FIG. 2—obliquely upwardly (and slightly forwardly), so that a cap 35 overlapping the free end of the bow rests automatically within the reach of the thumb of a right hand, which grips handle 8 and, with its forefinger rests against the trigger lever 25.

In its non-actuated position, the flap 32 drops down on account of its own weight, and rests on the trigger lever 25. A mere actuation of the pin 26 of the trigger valve 24 by the trigger lever 25 pivots the flap 32 in the actuating sense, but does not alone lead to sealing engagement of the liner 33 at the sleeve 30, and hence to closing of opening 29. To achieve this, a particular actuation of the flap 32 by a substantially vertical and upwardly directed movement of the bow 35 is required, whereby flap 32 is pivoted about its axis 31 in a counterclockwise direction. As long as opening 29 has not been closed, pressurized air flowing through passageway 27 upon actuation of trigger valve 24 is exhausted into atmosphere, without being able to open inlet valve 13 (by slide movement of valve piston 20).

It will be understood that numerous modifications may be made without departing from the spirit of the invention. Therefore no limitation not expressly set forth in the claims is intended, and none should be implied.

I claim:

1. A firing safety for a pneumatic nailer having a housing, a handle, and a pneumatically controlled inlet valve for pressurized air, and having a piston, and a trigger valve communicating with said inlet valve through a passageway whereby to actuate said piston to open said inlet valve upon actuation of said trigger valves; characterized by an opening from said passageway to atmosphere, and a manually operable safety valve for closing said opening, to permit actuation of said inlet valve.

2. A firing safety according to claim 1, characterized in that the safety valve consists of a flap pivoted to the nailer housing, which flap can be pressed into sealing engagement with said opening from said passageway.

3. A firing safety according to claim 2, characterized in that the pivot axis of said flap extends transversely of the main plane of said nailer.

4. A firing safety according to claims 2 or 3, characterized in that a manually operable bow is secured to said flap.

5. A firing safety according to claim 4, characterized in that said bow is angled upwardly into an oblique position, such that it lies within reach of the thumb of the hand gripping the handle of said nailer.

* * * * *